US008973508B2

(12) United States Patent
Al-Kaabi et al.

(10) Patent No.: US 8,973,508 B2
(45) Date of Patent: Mar. 10, 2015

(54) FREIGHT CAR WITH LIFTING LOCATION AND METHOD

(71) Applicant: National Steel Car Limited, Hamilton (CA)

(72) Inventors: Mohammed Al-Kaabi, Hamilton (CA); Jamal Hematian, Burlington (CA); Meysam Safari, Ancaster (CA)

(73) Assignee: National Steel Car Limited, Hamilton, Ontario (CA)

( * ) Notice: Subject to any disclaimer, the term of this patent is extended or adjusted under 35 U.S.C. 154(b) by 168 days.

(21) Appl. No.: 13/745,147

(22) Filed: Jan. 18, 2013

(65) Prior Publication Data

US 2014/0202354 A1 Jul. 24, 2014

(51) Int. Cl.
*B61D 3/20* (2006.01)
*B61D 17/00* (2006.01)

(52) U.S. Cl.
CPC . *B61D 3/20* (2013.01); *B61D 17/00* (2013.01)
USPC ..... 105/404; 105/355

(58) Field of Classification Search
CPC ..... B61D 3/20; B61D 17/00
USPC ..... 105/404, 407
See application file for complete search history.

(56) References Cited

U.S. PATENT DOCUMENTS 3,319,583 A 5/1967 Gulridge
3,357,371 A 12/1967 Gulridge
3,444,824 A 5/1969 Gutridge
3,777,671 A * 12/1973 Miller et al. ..... 105/420
4,091,742 A 5/1978 Cordani
4,456,413 A 6/1984 Pavlick
4,624,188 A 11/1986 Kaleta
4,686,907 A 8/1987 Woollam et al.
4,703,699 A 11/1987 Hill
4,750,431 A 6/1988 Yates et al.
4,754,709 A 7/1988 Gramse et al.
4,771,706 A 9/1988 Lindauer et al.
4,782,762 A 11/1988 Johnstone et al.
4,784,548 A 11/1988 Butcher et al.
4,805,539 A 2/1989 Ferris et al.
4,807,722 A 2/1989 Jamrozy et al.
4,841,876 A 6/1989 Gramse et al.
4,862,810 A 9/1989 Jamrozy et al.

(Continued)

FOREIGN PATENT DOCUMENTS

CA 1261203 A1 9/1989
CA 2146709 A1 10/1995

(Continued)

*Primary Examiner* — Zachary Kuhfuss
(74) *Attorney, Agent, or Firm* — Hahn Loeser & Parks LLP

(57) ABSTRACT

A railroad freight car has lifting apparatus at the body bolsters of the car. In addition it has lifting interface members mounted to underlie the side sills near the wheel-well cut-outs of the side beams. The lifting interface members stand downwardly proud of adjacent structure and fasteners heads, such that when lifting apparatus, such as a hydraulic lift, is brought to bear it contacts the lifting interface member first, rather than damaging adjacent structure, be it the side sills themselves, lateral cross-members such as cross-bearers and cross-ties, or diagonal struts. It may also tend to prevent consequent damage to the end bulkheads. The lifting interface members may permit the replacement of wheelsets in the field. The lifting members may be sacrificial, such that they may be replaced when worn or damaged.

32 Claims, 6 Drawing Sheets

(56) References Cited

U.S. PATENT DOCUMENTS

| | | | | |
|---|---|---|---|---|
| 4,893,567 | A | 1/1990 | Hill et al. | |
| 4,905,608 | A | 3/1990 | Terlecky et al. | |
| 4,909,157 | A | 3/1990 | Jamrozy et al. | |
| 5,085,152 | A | 2/1992 | Tylisz et al. | |
| 5,279,230 | A | 1/1994 | Thomas et al. | |
| 5,423,269 | A | 6/1995 | Saxton et al. | |
| 5,465,670 | A | 11/1995 | Butcher | |
| 5,501,556 | A | 3/1996 | Butcher et al. | |
| 5,520,489 | A | 5/1996 | Butcher et al. | |
| 5,562,046 | A | 10/1996 | Fetterman et al. | |
| 5,730,063 | A * | 3/1998 | Forbes et al. | 105/355 |
| 5,743,191 | A | 4/1998 | Coslovi | |
| 5,749,686 | A | 5/1998 | Butcher et al. | |
| 5,832,839 | A | 11/1998 | Forbes | |
| 6,196,137 | B1 | 3/2001 | Forbes | |
| 6,354,778 | B1 | 3/2002 | Coslovi et al. | |
| 6,505,564 | B2 | 1/2003 | Khattab | |
| 6,539,878 | B1 | 4/2003 | Coslovi et al. | |
| 6,550,399 | B1 | 4/2003 | Coslovi et al. | |
| 6,550,400 | B1 | 4/2003 | Forbes et al. | |
| 6,584,912 | B2 * | 7/2003 | Forbes | 105/419 |
| 6,666,148 | B1 | 12/2003 | Coslovi et al. | |
| 6,704,991 | B1 | 3/2004 | Coulborn et al. | |
| 6,866,452 | B2 * | 3/2005 | Khattab et al. | 410/94 |
| 6,968,788 | B1 | 11/2005 | Coslovi et al. | |
| 8,011,305 | B2 | 9/2011 | Al-Kaabi et al. | |
| 8,230,792 | B2 | 7/2012 | Khattab | |
| 2003/0029353 | A1 | 2/2003 | Coulborn et al. | |

FOREIGN PATENT DOCUMENTS

| | | |
|---|---|---|
| CA | 2094194 | 11/1995 |
| CA | 2175440 A1 | 10/1997 |
| CA | 2175445 A1 | 10/1997 |

* cited by examiner

FREIGHT CAR WITH LIFTING LOCATION AND METHOD

FIELD OF THE INVENTION

This invention relates to the field of railroad freight cars, and, in particular to railroad freight cars having structural lifting locations such as may be used to support a car body in the absence of one or more trucks thereof.

BACKGROUND

Railroad freight cars may be constructed with side beams that carry distributed lading loads to the end sections of the cars. In a deep side beam the top chord typically carries compressive loads, and the side sill, which typically defines the bottom chord of the beam, carries loads in tension. Since the side sill is a primary structural member in a well car, it may be desirable to avoid conditions that may impair its function, or that may give rise to unexpected or unknown secondary loading conditions.

One type of car in which a deep side-beam performs this role is an intermodal well car. A well car body is required to withstand three kinds of loads. First, it must withstand longitudinal draft and buff loads inherent in pulling or pushing a train, particularly those loads that occur during slack run-ins and run-outs on downgrades and upgrades, and single-ended impact load. Second, the well car must support a vertical load due to the trailers or shipping containers it carries. Third, it must be able to withstand lateral or roll loading as the well car travels along curves and switch turn-offs.

The floor structure of a container carrying well car includes lading bearing cross members (a) at the ends of the well in the 40 foot container pedestal positions, and (b) in the middle of the well in the form of a central cross member to support containers at the 20 foot position. These vertical load bearing cross members support the shipping container corners. The floor structure may also include several intermediate cross members, and diagonals.

The loads transmitted by the floor structure are carried into the side beams, and from the side beams into the end sections of the car. The end portions of the side beams are typically shallow, with a cut-out, or relief, to accommodate motion and maintenance access of the truck that supports the end of the car. In the end portion of the car the vertical loads flow to the centerplate, or equivalent structure, whence they are carried into the truck and, ultimately, reacted by the rail and roadbed.

SUMMARY OF THE INVENTION

In an aspect of the invention there is a rail road freight car. It has a lifting interface member mounted to a side sill thereof at a location inboard of a nearest truck center of the freight car.

In a feature of that aspect of the invention, the lifting interface member extends downwardly proud of all adjacent structure of the freight car. In another feature, the freight car has a truck clearance envelope, and the lifting interface member is mounted longitudinally inboard of the truck clearance envelope. In still another feature, the railroad freight car has a laterally extending beam. The laterally extending beam is mounted above the truck clearance envelope. The beam has lateral extremities defining jacking pads of the freight car, the jacking pads being in addition to having a lifting structure at the location inboard of the nearest truck center at which the lifting interface member is mounted. In a further feature, the lifting interface member defines a doubler extending along the side sill. In another feature, the doubler is a replaceable sacrificial member. In still another feature, the doubler is made of any one of: (a) steel; (b) a UHMW polymer; and (c) a reinforced polymer resin. In a yet further feature, the side sill has a predominantly upright leg and a predominantly laterally inboard extending leg. The laterally inboard extending leg has an underside; and the lifting interface member is mounted to the underside of the laterally inboard extending leg. In another feature, that aspect and any of its features may be used in a method of supporting at least a part of the car body to facilitate wheel change in the field.

In another feature, the freight car has first and second spaced apart, lengthwise running side beams defining primary load paths of the freight car through which vertical lading loads are carried. The side sill defines a bottom chord member of one of the side beams. The side sill has an underside. The lifting interface member is mounted to the underside of the side sill. In another feature, the first beam has an end relief defined therein to accommodate a truck of the railroad freight car. The lifting interface member is mounted to the side sill next adjacent to the end relief. In still another feature, the car is a well car.

In another aspect of the invention, there is a railroad well car body unit. It has first and second end sections; and first and second side beams. The first and second side beams are spaced apart cross-wise, and extending lengthwise between the first and second end sections whereby a well is defined between the first and second side beams and the first and second end sections. The first end section has a truck center at which to mount a first railroad freight car truck. The first side beam has a first side sill. The first side sill has a first end adjacent to the first end section, and a second end distant from the first end section. At least a portion of the first end of the first side sill having a lifting interface member mounted thereto. In a further feature, the well car body unit has at least a first cross-member and a second cross-member. The first cross-member extends between the first side beam and the second side beam. The second cross-member extends between the first side beam and the second side beam. The first cross-member defines a first seat for an end of a shipping container. The second cross-member defines a second seat for an end of a shipping container. The first cross-member is located closer to the first end section than is the second cross-member. The lifting interface member is mounted to the first side sill and extends lengthwise relative thereto. The lifting interface member is located between the first end of the side sill and the first cross-member. In a further feature, there is a distance between the first end of the side sill and the first cross-member, and the lifting interface member extends over more than half of the distance. In a still further feature, the lifting interface member extends over substantially all of the distance. In another feature the lifting interface member terminates longitudinally inboard of the first cross-member.

In yet another feature, the lifting interface member extends downwardly proud of all adjacent structure of the railroad well car. In another feature, the body unit has any of (a) a container support cross-member; (b) a cross-tie; and (c) a diagonally cross-wise extending brace; and the lifting interface member stands downwardly proud of all such items (a), (b), and (c). In another feature, the first end section includes a beam extending laterally thereacross. The main bolster has first and second ends at lateral extremities thereof laterally outboard of the first truck center; and jacking points are defined at the first and second ends of the main bolster. In another feature, the first side beam has a relief defined therein to accommodate a first truck of the railroad freight car and the lifting interface member is mounted to the side sill next adjacent to the relief. In still another feature, the well car has an end sill member extending between the first end of the first side sill, a corresponding first end of a corresponding side sill of the second side beam, and the lifting interface member extends along the first side sill in a region thereof between the end sill member and the first cross-member. In another feature, the lifting interface member undergirds the side sill. In still another feature, the first side sill has an underside, and the lifting interface member includes a doubler mounted to the underside of the first side sill. In a further feature the doubler is a removable sacrificial member. In another feature, the sacrificial member is made from any one of (a) steel; (b) an UHMW polymer; and (c) a composite-reinforced polymer resin. In still another feature, the railroad well car is a multi-body-unit railroad car. In a yet further feature, the railroad well car is an articulated railroad well car having at least a first body unit, a second body unit, and a first shared truck located between the first body unit and the second body unit; the first end section of a part of the first body unit; and the lifting interface member is mounted to the first side sill next adjacent to the first shared truck.

In another feature, the first side sill has a first leg and a second leg; the first leg extending predominantly upwardly; and the second leg extending predominantly laterally inwardly from a lowermost portions of the first leg. In a further feature, the well car body unit has at least a first cross-member and a second cross-member. The first cross-member extends between the first side beam and the second side beam and has first and second ends that mount upon respective second legs of respective side sills of the first and second side beams. The second cross-member extends between the first side beam and the second side beam and has first and second ends that mount upon respective second legs of respective side sills of the first and second side beams. The first cross-member defines a first seat for an end of a shipping container. The second cross-member defines a second seat for an end of a shipping container. The first cross-member is located closer to the first end section than is the second cross-member. The lifting interface member undergirds the first side sill and extends lengthwise relative thereto, the lifting interface member is located between the first end of the side sill and the first cross-member. In another feature the first cross-member is connected to the first and second side beams at a moment connection. In still another feature, the first side beam of the well car has a vertical stiffener abreast of the first cross-member.

In another feature, the first end section has panel extending across the car and mating with the first and second side beams, the panel defining an end bulkhead of the well. The first side beam has a first predominantly upright stiffener located abreast of the end bulkhead. The first side beam has a second predominantly upright stiffener located abreast of the first cross-member. The first cross-member and the second predominantly upright stiffener of the side beam is joined at a moment connection. In another feature, the first side beam has a third predominantly upright stiffener located between the first and second predominantly upright stiffeners, and the lifting interface member extends long the side sill to either side of the third predominantly upright stiffener.

In another aspect of the invention there is a method of lifting a railroad car having a lifting interface member mounted under a side sill adjacent to a wheel well, the method including using a jacking device to lift the car body under the side sill instead of lifting the car body by use of jacking points at the end of a body bolster. That aspect of the invention may include avoiding impinging upon any other structural members of the car, such as transverse diagonal braces, exposed fastener ends or heads, cross-beams, container support members, or cross ties while engaging the lifting interface member.

These and other aspects and features of the invention may be understood with reference to the description which follows, and with the aid of the illustrations.

BRIEF DESCRIPTION OF THE FIGURES

The description is accompanied by a set of illustrative Figures in which.

DETAILED DESCRIPTION

Figure 1A:
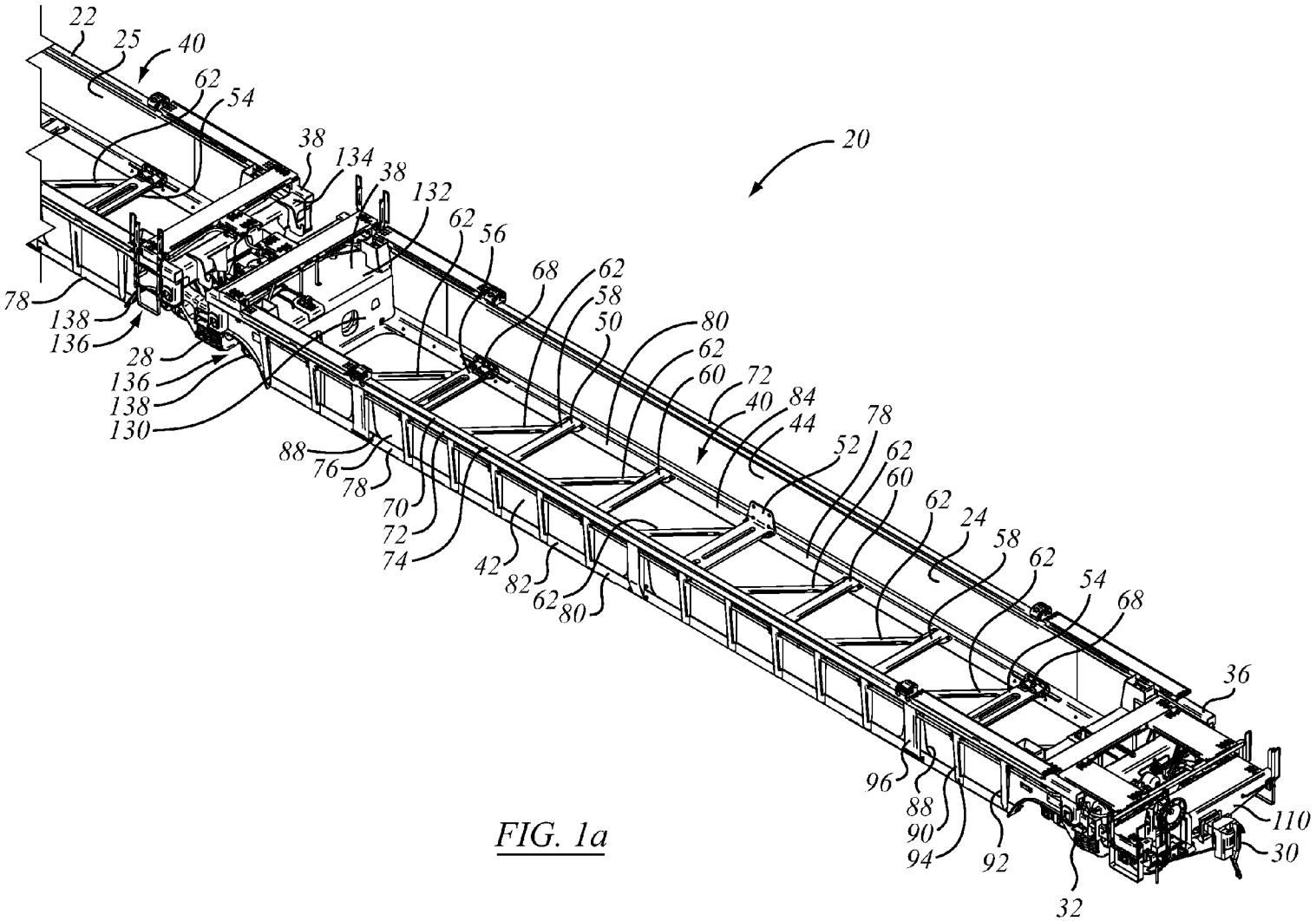
FIG. 1*a* is a general arrangement, isometric view from above and to one corner of an end unit and a portion of an adjacent internal unit of a multi-body unit intermodal well car.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology used in this specification is thought to be consistent with the customary and ordinary meanings of those terms as they would be understood by a person of ordinary skill in the rail road industry in North America. The Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record, (for example, earlier publications by persons not employed by the USPTO or any other Patent Office), demonstrating how the terms are used and understood by persons of ordinary skill in the art, or by way of expert evidence of a person or persons of at least 10 years' experience in the rail road industry in North America or in other former territories of the British Empire and Commonwealth.

In terms of general orientation and directional nomenclature, for rail road cars described herein the longitudinal or lengthwise direction is defined as being coincident with the rolling direction of the rail road car, or rail road car unit, when located on tangent (that is, straight) track. In the case of a rail road car having a center sill, be it a stub sill or a straight-through center sill, the longitudinal direction is parallel to the center sill, and parallel to the top chords and side sills, as may be. Unless otherwise noted, vertical, or upward and downward, are terms that use top of rail, TOR, as a datum. In the context of the car as a whole, the terms cross-wise, lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than". The directions correspond generally to a Cartesian frame of reference in which the x-direction is longitudinal, the y-direction is lateral, and the z-direction is vertical. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, a description of one half of the car may generally also be intended to describe the other half as well, allowing for differences between right hand and left hand parts. In this description, if used, the abbreviation kpsi stands for thousands of pounds per square inch.

In this discussion it may by understood that persons of ordinary skill in the art are familiar with the Rules and Standards of the Association of American Railroads (the AAR), which govern interchange service in North America. This specification or the accompanying illustrations may refer to standards of the Association of American Railroads (AAR), such as to AAR plate sizes. To the extent necessary or appropriate, those references are to be interpreted in a manner consistent with the Rules and Standards as extant on the earliest of the date of filing of this application or the date of priority of the earliest application from which this application claims priority, as if they formed part of this specification on that date.

Also for the purposes of the present discussion, it may be taken as a default that the structure of the car is of mild steel fabrication except as otherwise shown in the illustrations or indicated in the text. This need not necessarily be the case. Other materials, such as aluminum or stainless steel might be used. The components may typically be of welded construction, although mechanical fasteners including threaded fasteners and mechanical deformation fasteners such as Huck™ Bolts may also be used.

Figure 1B:
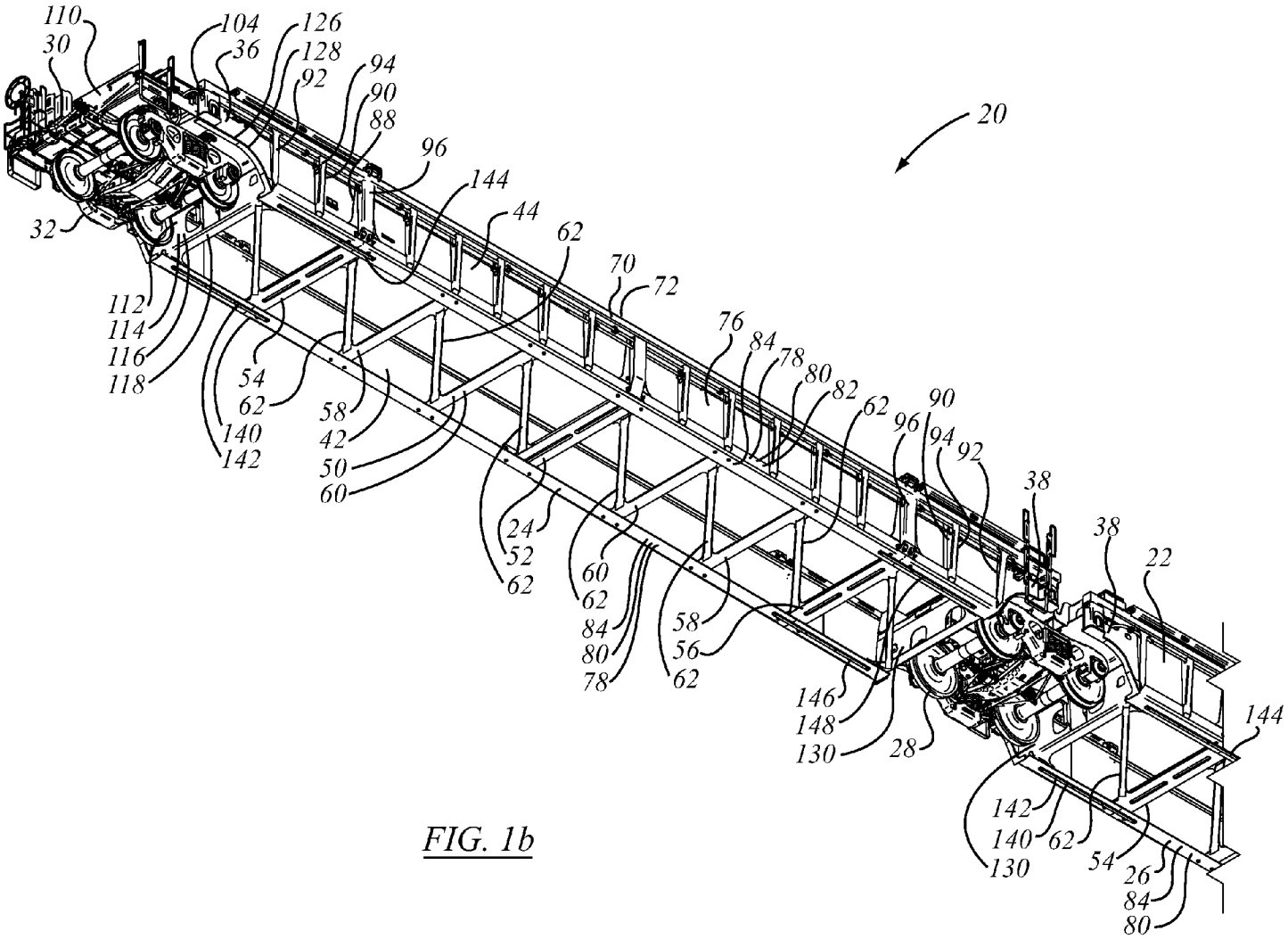
FIG. 1*b* is an isometric view of the intermodal well car of FIG. 1*a*, taken from below and to the other side.
Figure 1C:
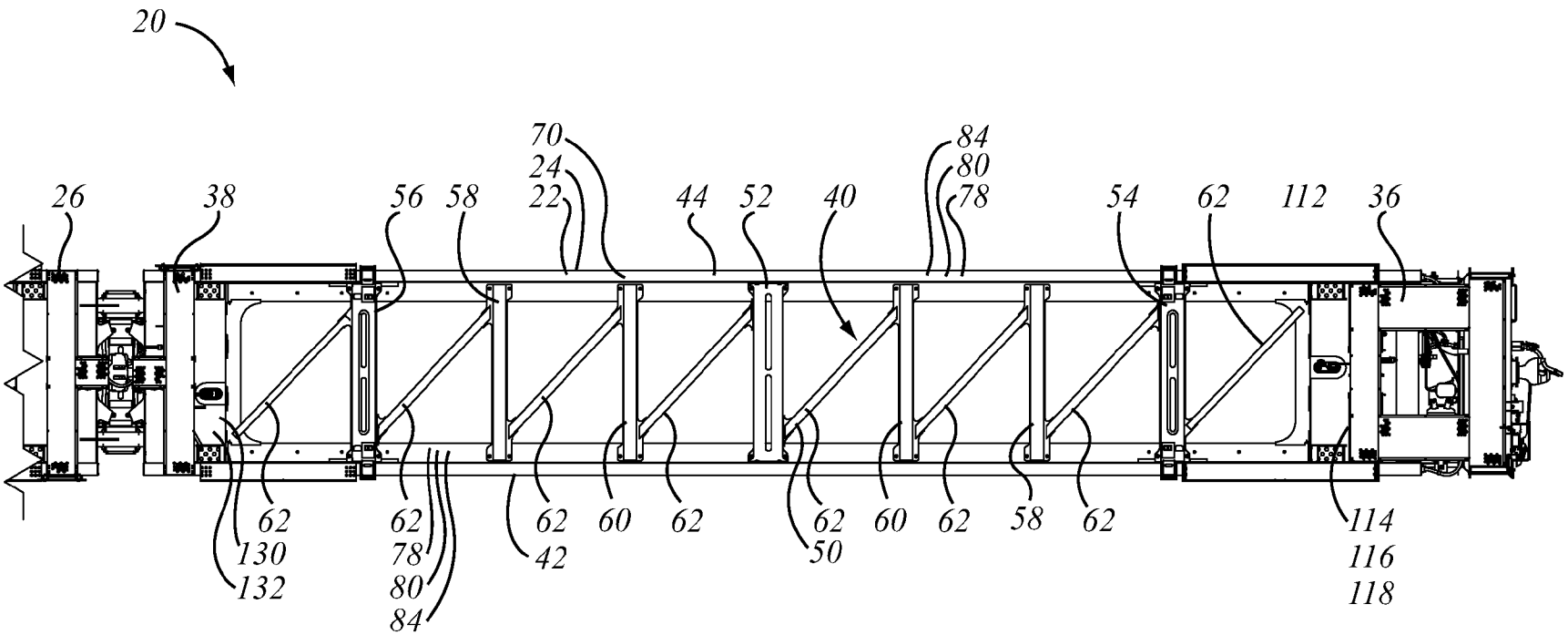
FIG. 1*c* is a top view of the intermodal well car of FIG. 1*a;*
Figure 2A:
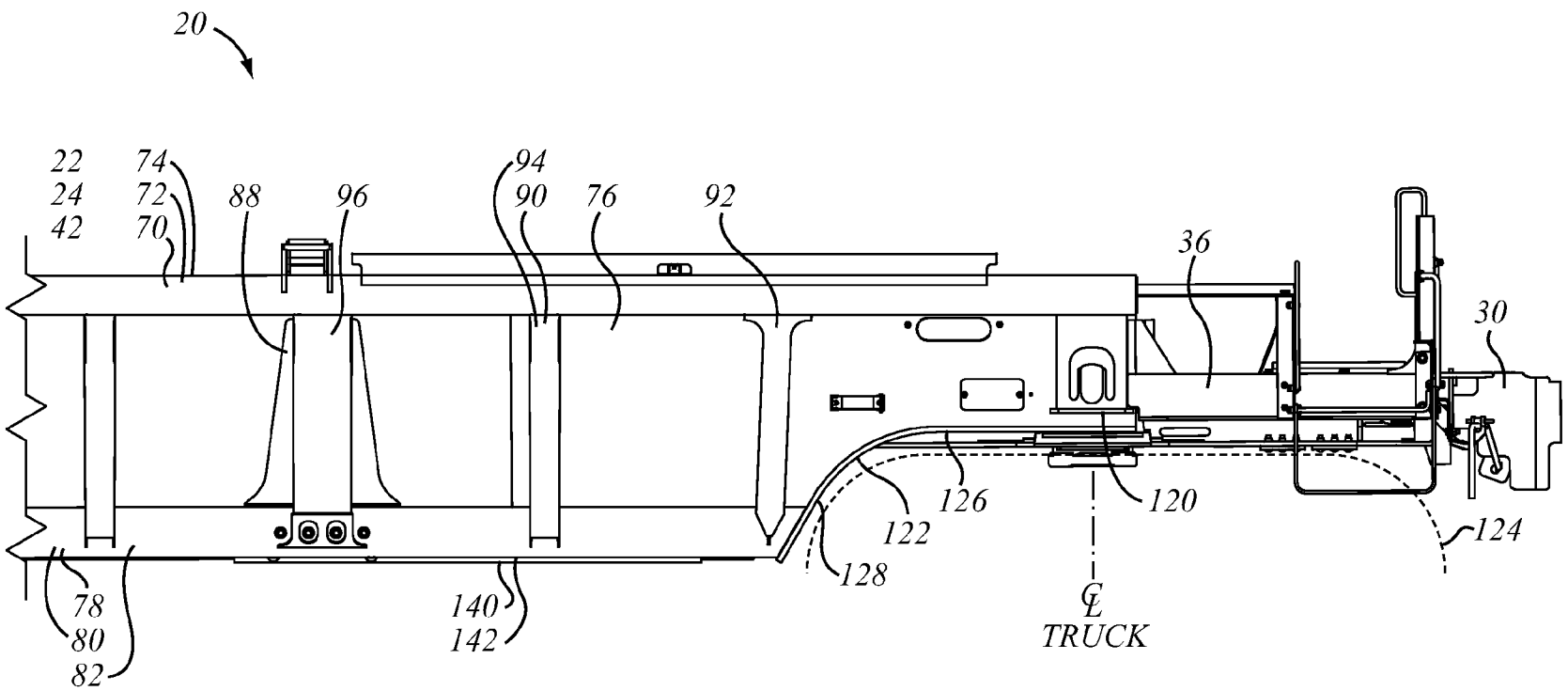
FIG. 2*a* is a side view of an end potion of the intermodal well car of FIG. 1*a;*
Figure 2B:
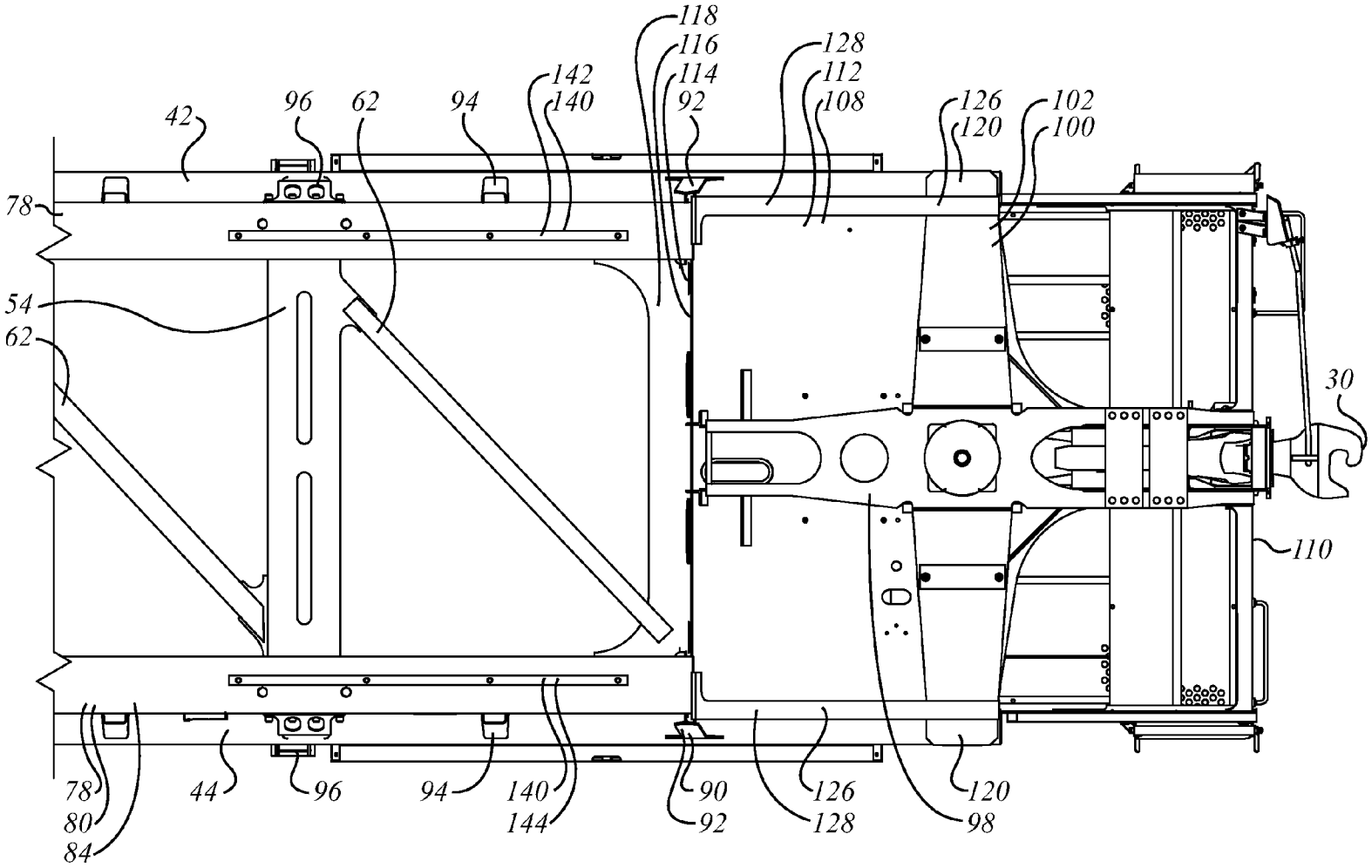
FIG. 2*b* is a bottom view of the end of the intermodal well car of FIG. 2*a;*
Figure 3B:
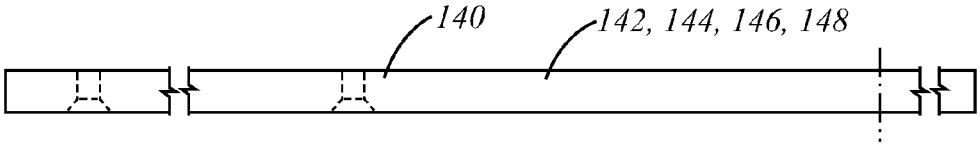
FIG. 3*b* is a side view of the lifting interface member of FIG. 3*a;*
Figure 3C:
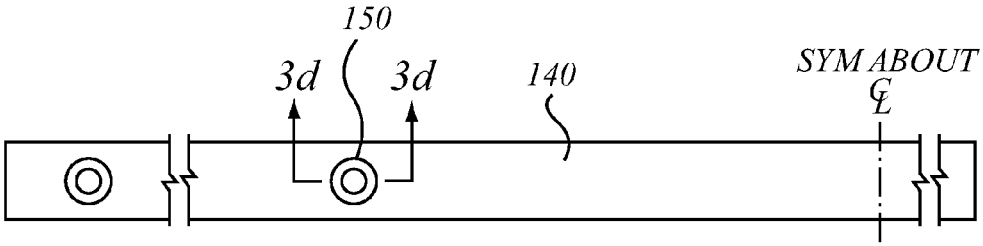
FIG. 3*c* is a bottom view of the lifting interface member of FIG. 3*a*.
Figure 3D:
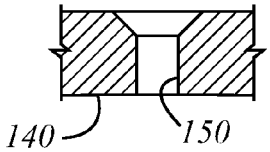
FIG. 3*d* is a cross-sectional detail of the lifting interface member of FIG. 3*a* taken on section '3*d*-3*d*' of FIG. 3*c*.
Figure 3A:
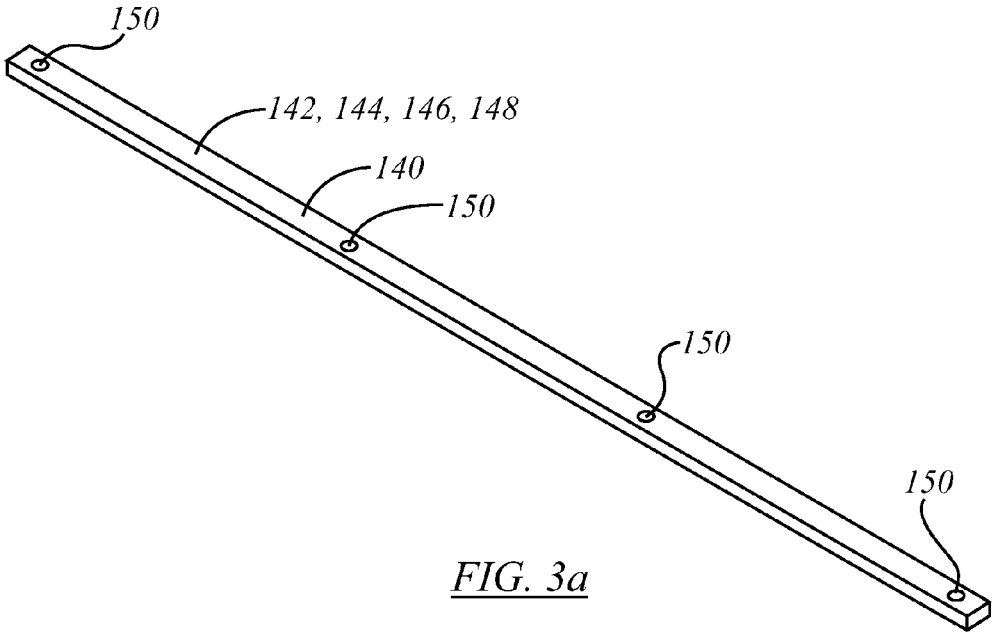
FIG. 3*a* is an isometric view of a lifting interface member of the intermodal well car of FIG. 1*a;*

FIGS. 1*a*, 1*b*, and 1*c* show a rail road freight car 20. Freight car 20 may be a well car, indicated generally as 22, and may be a multi-body unit well car in which two or more body units are connected together, whether by substantially permanent articulated connectors or draw bars. For example, freight car 20 may have a first car body, or first body unit 24 and a second body unit 26 longitudinally next adjacent thereto, with a shared truck 28 therebetween. For the purposes of illustration, only a portion of second body unit 26 is shown, it being understood that second body unit has a far end, and may be an internal body unit of a multi-unit car such as a three-pack or five-pack articulated railroad car. First body unit 24 may be an end body unit having a releasable coupler 30, mounted to a draft sill that extends longitudinally outboard of an end truck 32. Whether single unit or multi-unit, the major structural elements of car 20 are symmetrical about the longitudinal axis of the car and also about the mid-span transverse axis. Trucks 28 and 32 (and such other trucks as may be) support rail road freight car 20, and in particular body unit 24 for rolling motion in the longitudinal direction (i.e., along the rails). The car has a longitudinal vertical plane of symmetry running along the longitudinal centerline.

Rail car body unit 22 includes a pair of first and second, longitudinally spaced apart, end structures 36, 38 each mounted over a respective one of rail car trucks 28, 32; and a pair of opposed, spaced apart, parallel first and second, longitudinally extending, deep side beam assemblies in the nature of left and right hand longitudinally extending side beams 42, 44. Side beams 42, 44 are mounted to extend between end structures 36, 38. A well 40 is defined longitudinally between end structures 36, 38. Side beams 42 and 44 define sides of well 40.

A structural assembly 50 includes a first structural cross member in the nature of a main central container support cross beam 52 in the mid-span position that extends perpendicular to, and between side sills 42, 44; a pair of first and second end structural cross members in the nature of container support end cross beams 54 and 56 located at the "40 foot" locations roughly 20 feet to either side (in the longitudinal direction of car 20) of main cross beam 52; intermediate structural members, or struts, in the nature of intermediate cross-ties 58, 60; and diagonal cross-braces 62. Diagonal cross braces 62 co-operate with beams 52, 54, 56 and cross-ties 58, 60 to act as a shear transferring assembly, or structure, mounted between side sills 42, 44, for resistance to lateral loading of the car, as in cornering. The construction of cross beams 52, 54 and 56 which join side sill assembly 42 to side sill assembly 44, is as described in greater detail in U.S. Pat. No. 6,505,564.

Within the allowance for longitudinal camber of car 20 generally, all cross members 52, 54, 56, 58 and 60 are preferably parallel to, and generally coplanar with, one another. When installed, center member 52 may be marginally higher than the other cross members 54, 56, 58 and 60. This nevertheless may still tend to permit the relatively level loading of intermodal cargo containers which are raised at one end by container cones 68 located on end cross beams 54 and 56.

Cargo loads, such as intermodal cargo containers or other types of shipping containers carried by rail car 20, are intended to be supported primarily, if not entirely, by cross members 52, 54 and 56. That is, it is not intended that vertical container loads due to gravity should be borne by either intermediate cross members 58, 60 or by diagonal braces 62. Locating cones 68 help to locate a container relative to cross members 54 and 56. The cross members 52, 54 and 56 are located so that the well 40 can accommodate either two 20 foot containers, each with one end located on cones 68 and the other end resting on center cross member 52, or a single 40 to 53 foot container, also located on cones 68 at either end. In this arrangement, cross members 52, 54, and 56 define the load paths by which the vertical loads of the lading are carried into the side beams For the purposes of this description, the structure of one side beam is the same as the structure of the other side beam. Consequently a description of one side beam will serve also to describe the other. The assembly of side beam 42 has an upper longitudinally extending structural member in the nature of a top chord member 70, which may have the form of a four sided hollow tube 72. A top chord doubler plate 74, of significant thickness (such as 1") may be welded to the upper wall, or flange, of tube 72 and runs for about 35 feet along a central portion of top chord member 70 corresponding to the region of highest bending moment. The hollow tube 72 may be a steel tube of square cross-section. A shear transfer member in the nature of a side sheet identified as web 76 is attached by a lap weld to, and extends downwardly from, the inner (i.e., laterally inboard) face of hollow tube 72. At its lower edge, web 76 is welded to a lower, longitudinally extending structural member in the nature of a bottom chord member, namely side sill 78. Side sill 78 may have the form of heavy angle 80. Side sill 78 has a first leg 82, first leg 82 being an upstanding leg that extends predominantly or entirely in the vertical direction, and to which web 76 is lap welded. Side sill 78 also has a second toe, or second leg, 84, that is a laterally inwardly extending leg.

Side sills 42, 44 each include an array of upstanding, or vertically extending, reinforcement members 90, in the nature of stiffeners, or posts 92, 94, 96 and so on, that extend between side sill 78 and top chords 70. The various posts may be designated a first side stiffener 92, a second side stiffener 94, a third side stiffener 96, and so on along the car, numbering inward from the ends toward the middle. Side posts 92, 94, 96 and so on may have the form of steel channel sections welded along the outside face of the webs of side beams 42, 44. The legs of the channel section may be tapered from a wide top to a narrower bottom. The back of the channel stands outwardly from web 76, and the toes of the channel abut web 76 to form a closed hollow section. Side posts 92, 94, 96 and so on may be located abreast of, i.e., at longitudinal stations corresponding to, the longitudinal stations of the junctions of cross members 58, 60 with the side sills 42, 44, and also at longitudinal stations intermediate to the longitudinal stations of the cross beams and cross ties, and longitudinally outboard of cross beams 54, 56. The longitudinal pitch of the reinforcement members 90 may be about 40 inches from the next adjacent side stiffener post.

The posts located abreast of the junctions of main container support cross-members 52, 54 and 56 with side sills 78 of side beams 42, 44 may be of greater cross-sectional second moment of area, and cross-sectional area, than the other side reinforcement posts. They may further have doubler sheets or plates 88 mounted to the web sheet of the side beam at these location. For example, post 96 may have the form of a tapered channel mounted to side sills 42, 44 at longitudinal stations corresponding to the 40 foot container support positions. The difference in section reflects a difference in function. Main cross members 52, 54, and 56 are connected to side sills 78 of side beams 42, 44 at moment connections, that is, connections at which a moment about the longitudinal or x-axis of the car, parallel to the car centerline, can be transmitted between the side posts and the cross-members. Huck bolts may be used at these connections. The cross-members and side-posts then form what is effectively a large spring whose uppermost toes are connected to the side sill, one of the functions of the springs so formed being to resist lateral deflection of the top chords.

Side sills 42, 44 are mounted to end structures 36 and 38 at either end of car 20. Each of the end structures 36 and 38 each has a stub center sill. At the truck end the draft sill defines a mounting a railway coupler. At an internal end of a multi-body-unit car the stub sill may provide a mounting for an articulated connector or a draw bar.

At first end section, or end structure, 36, there is a longitudinally extending stub sill 98 and a laterally extending beam 100, which may be identified as main bolster 102 extends laterally to either side of the stub sill. The truck center is defined at the intersection of stub sill 98 and main bolster 102. The stub sill and main bolster are overlain by cross-wise and length-wise extending plate, which may be identified as end shear plate 108. The laterally outboard margins shear plate 108 mate with side beams 42 and 44. The laterally outboard distal ends 104 of main bolster 102 are extends transversely or laterally outboard to, and is structurally connected to, side beams 42, 44. The structure so defined, and in particular main bolster 102, receive, and provide a reaction to, the loads carried in side beams 42, 44. An end sill 110 runs between the side sills and the longitudinally outboard end of the stub sill. At the inboard end of the stub sill there may be a panel, or plate, or assembly, 112 defining an end bulkhead 114 of well 40. End bulkhead 112 extends cross-wise between, and is connected to, side beams 42, 44. The main portion 116 of bulkhead 112 is predominantly upstanding, and is located abreast of, or substantially abreast of, first post 92. At its lower extremity bulkhead 112 may have an horizontal, laterally extending flange 118 having ends that mate with the predominantly horizontal leg 84 of angle 80. The laterally outboard distal ends of main bolster may protrude somewhat past side beams 42, 44, and may define one or both of lifting lugs and jacking pads 120, (that is, the same structural feature may be lifted by a crane, and so therefore be called a lifting lug, or it may be lifted by jacking from below, and therefore be called a jacking pad) by which the first end or car body unit 24 may be lifted, as, for example, for maintenance or replacement of truck 32.

Side beams 42, 44, each have an end cut-out, or relief, or accommodation, 122 that conforms to the operating envelope 124 of the truck, e.g., truck 32, mounted at the associated truck center. Operating envelope 124 is indicated in phantom lines representing a three dimensional zone defining the space allowance required by truck 32 (or, truck 28, as may be) during yawing, pitching, and rolling in service. Adjacent to envelope 124, running along the lower margin of beam 42, (or 44, as may be) there is a flange 126 that may mate with (or may be defined by) the laterally outboard margin of shear plate 108. Flange 126 runs from end sill 110 to side sill 78, and has an angled, or curved, or swept transition portion 128 that extends through the change of height between shear plate 108 and side sill 78.

Second end structure 38 is substantially similar to end structure 36, the major difference being that second end structure 38 is an internal car body end structure suitable for a multi-body-unit articulated car. In such a car, although the second end bulkhead structure 130 is substantially the same, if not identical to end bulkhead 114, end shear plate 132 is shorter in length than shear plate 108, and instead of main bolster 102 there is a body bolster or cross-beam 134 that also defines the internal end sill of the car body running between side beams 42 and 44. Rather than having a truck center and center plate, the internal end stub sill has, typically welded to it, the shank of one end of an articulated connector that, itself, has a center plate that seated on the center plate bowl of a shared truck, such as truck 28. Side bearing arms may typically extend longitudinally from cross-beam 134. Second end structure 38 has a cut-out, or relief, or accommodation 136 and swept flange 138 that are substantially similar to accommodation 122 and flange 126, but being shorter in longitudinal extent given the relationship of a shared truck installation such as with truck 28, rather than an end truck installation, such as with truck 32. As with main bolster 102, cross-beam 134 has ends that extend laterally outboard beyond side beams 42, 44, and at which jacking pads 120 are found. As may be understood, a single body unit car will have end structures 36 at both ends, and an internal car body unit of a multi-unit articulated car will have end structures 38 at both ends.

It sometimes happens that there is a need to lift or otherwise support one end or another of a car body, or the entire car body. The well car is normally jacked from jacking pads 120 at the four corners of the car, namely at the ends of the body bolsters, such as main bolster 102 or cross-beam 134. Hooks and cranes are used for this purpose. However, in the field not all yards and maintenance facilities have this lifting equipment. That is, a wheelset may fail, or a truck may need to be replaced. The nearest maintenance facility may not necessarily have overhead lifting equipment suitable for lifting the end of a car body. The car may need to be jacked in a situation where wheels need to be changed in the field.

In these circumstances it may be tempting to try to lift the car by applying jacks underneath the ends of the side sills, closely adjacent to the wheel wells, or by lifting the car by its diagonal shear braces. These braces are typically designed to function as struts that take loads only in lengthwise compression or tension. They are not typically designed to take loads in out-of-plane bending, and are not designed to carry the weight of the car. If bent due to abuse, the integrity of the braces in compression may be impaired. Incautious or over-enthusiastic efforts in this regard may result in damage to the side sill or the diagonal braces. Inasmuch as the side sills are primary load transmitting structure, damage to the side sills may not be desirable. Alternatively, jacking the car under the diagonal braces at the ends of the car may be prone to damage the end bulkhead. Again, such damage may be undesirable.

As seen in FIG. 1*b*, car 20 is provided with alternate members, 140 in the form of extended-length jacking pads 142, 144, 146 and 148 at each of the ends of side sills 78 of side beams 42 and 44. Members 140 may be termed lifting or jacking pads, but may also be termed wear members, or structural protection members, or load spreaders, or jacking pad protectors, or, generically, lifting interface members. Pads 142, 144, 146, and 148 each have a thickness that is greater than the exposed collar length of the Huck bolts (or other fasteners) used to secure cross-members 52, 54 and 56 to side sills 78. The thickness is also such as make the downward facing portion or surface extend proud of the lowermost extremity of adjacent structure, i.e., the diagonal cross-braces, Huck bolt collars, and so on, such that an apparatus lifting the car body will run into, and lift, member 140 before it can contact the diagonal cross braces or the fasteners. Each member 140 may have countersunk bores 150, and corresponding flush-headed, (or shy) fasteners by which any of members 140 may be secured to side sill 78, or detached therefrom and replaced if or when damaged or worn out. Members 140 may in that sense be wear plates, and may be sacrificial or consumable. The flush, (or shy) heads of the fasteners prevent a lifting device from applying a concentrated point load that may otherwise damage side sill 78. In one embodiment that thickness (i.e., the vertical dimension of the pad as installed) may be 2 inches (or more). The pads may be made of mild steel. The pads may be made of a hard plastic, such as a UHMW plastic or a fibre reinforced resin. Flat bar may be used for this purpose, as may a square or rectangular structural section, such as a seamless steel section. Alternatively, the toes of a steel angle or channel may be welded to the underside of side sill 78, such that any jack will bear against that channel or angle iron. There is no such pad at the mid span location of central container support cross-member 52.

Pads 142, 144, 146 and 148 extend from a first end, closely adjacent to the end of side sill 78 where it meets flange 126 or flange 138 as may be. That end of the jacking pad is substantially abreast of, or longitudinally inboard of, first post 92, and is longitudinally inboard of the end bulkhead, be it 114 or 130. The other end of pad 142, 144, 146 or 148, as may be, extends past third post 96, i.e., past the respective container support end cross-member 54 or 56, and longitudinally past the footprint of the Huck bolt collars that protrude from the underside of side sill 78 at that location. That location is a reinforced location of the car body, and Notice may be applied to the external face of side sill 42, 44 in this location "jack under side sill here", or words and symbols of similar effect, as well as notice "Lift only when car is empty" or similar. In the embodiment shown, members 140 are not applied to the diagonal braces, and corresponding notices of "Do not lift car by diagonal braces" may also be applied to the sides of the car, and to the diagonal braces themselves. The pads may have a length of more than 36 inches such as may allow for inaccuracy or for such difficulties as may present themselves in a non-optimal repair environment. As may be noted, members 140 each extend to either side of second post 94. Further, members 140 each extend across one full bay, or more, of the respective side beam 42, 44. "One full bay" is defined from the centerline of one stiffener (e.g., 94) to the centerline of the next adjacent stiffener (e.g., 96). The length of members 140 may be greater than the spacing between forks of a fork-lift truck such as may be used to lift fork-lift pallets (typically about 30-42 inches) or bundles of lumber (typically 4-6 feet). The length of members may similarly be in the range of 60-100 inches, and may, in one embodiment, be about 7 ft long, giving a relatively large range of choice to an operator. The location of members 140 allows clearance above the rail to allow a jacking device to be inserted.

In use, the car is to be lifted only when there is no lading in the well of the car, i.e., all shipping containers have first been removed.

The procedure for changing out defective wheels in the field rather than uncoupling the car from the train, and sending the car on a "bad order" to a maintenance shop (which might otherwise take several days), personnel may locate the train on a track, which may be a siding, use an hydraulic lift on-site while the car is still coupled to the train, and change out a defective wheel-set in the field. There may be no overhead cranes available that would otherwise lift the car by the jacking pads at the body bolsters. By securing the trucks to the car body (or adjacent bodies, where shared) the car body, including the trucks and, as may be required, the wheelsets, may all be raised at the same time.

Various embodiments have been described in detail. Since changes in and or additions to the above-described examples may be made without departing from the nature, spirit or scope of the invention, the invention is not to be limited to those details.

What is claimed is:

1. A railroad freight car having:

first and second side sills;

a truck center, and a truck clearance envelope, each of said first and second side sills having a first end nearest to said truck clearance envelope;

a first cross-member running between said first and second side sills nearer to said truck center than is any other cross-member;

each of said first and second side sills having a first end nearest to said truck center;

a lifting interface member mounted to said first end of said first side sill inboard of said first truck center of said freight car; and said lifting interface member being located between said first end of said first side sill and said first cross-member.

2. The railroad freight car of claim 1 wherein said lifting interface member extends downwardly proud of all adjacent structure of said freight car.

3. The railroad freight car of claim 1 wherein said lifting interface member is mounted longitudinally inboard of the truck clearance envelope.

4. The railroad freight car of claim 3 wherein said railroad freight car has a laterally extending beam; said laterally extending beam is mounted above the truck clearance envelope, said beam having lateral extremities defining jacking pads of said freight car; and said jacking pads being in addition to having a lifting structure at said location inboard of said nearest truck center at which said lifting interface member is mounted.

5. The railroad freight car of claim 1 wherein said lifting interface member defines a doubler extending along said side sill.

6. The railroad freight car of claim 5 wherein said doubler is a replaceable member.

7. The railroad freight car of claim 5 wherein said doubler is made of any one of: (a) steel; (b) a UHMW polymer; and (c) a reinforced polymer resin.

8. The railroad freight car of claim 1 wherein said side sill has a predominantly upright leg and a predominantly laterally inboard extending leg; said laterally inboard extending leg has an underside; and said lifting interface member is mounted to said underside of said laterally inboard extending leg.

9. The railroad freight car of claim 1 wherein said freight car has first and second side beams, said side beams being spaced apart, and lengthwise running, said first and second side beams defining primary load paths of said freight car through which vertical lading loads are carried; said side sill defines a bottom chord member of one of said side beams, said side sill has an underside; and said lifting interface member is mounted to said underside of said side sill.

10. The railroad freight car of claim 9 wherein:

said first side beam has an end relief defined therein to accommodate a truck of the railroad freight car; and said lifting interface member is mounted to said side sill adjacent to said end relief.

11. The railroad freight car of claim 1 wherein said car is a well car.

12. A railroad well car body unit comprising:

first and second end sections;

first and second side beams;

said first and second side beams being spaced apart crosswise, and extending lengthwise between said first and second end sections whereby a well is defined between said first and second side beams and said first and second end sections;

said first end section having a truck center at which to mount a first railroad freight car truck;

said first side beam having a first side sill;

said first side sill having a first end adjacent to said first end section, and a second end distant from said first end section; and at least a portion of said first end of said first side sill having a lifting interface member mounted thereto;

at least a first cross-member and a second cross-member;

said first cross-member extends between said first side beam and said second side beam;

said second cross-member extends between said first side beam and said second side beam;

said first cross-member defines a first seat for an end of a shipping container;

said second cross-member defines a second seat for an end of a shipping container;

said first cross-member is located closer to said first end section than is said second cross-member; and said lifting interface member is mounted to said first side sill and extends lengthwise relative thereto, said lifting interface member being located between said first end of said first side sill and said first cross-member.

13. The railroad well car body unit of claim 12 wherein there is a distance between said first end of said side sill and aid first cross-member, and said lifting member extends over more than half of said distance.

14. The railroad well car body unit of claim 13 wherein said lifting interface member extends over substantially all of said distance.

15. The railroad well car body unit of claim 12 wherein said lifting interface member terminates longitudinally inboard of said first cross-member.

16. The railroad well car body unit of claim 12 wherein said lifting interface member extends downwardly proud of all adjacent structure of said railroad well car.

17. The railroad well car body unit of claim 12 wherein said body unit has any of (a) a container support cross-member;

(b) a cross-tie; and (c) a diagonally cross-wise extending brace; and said lifting interface member stands downwardly proud of all such items (a), (b), and (c).

18. The railroad well car body unit of claim 12 wherein:

said first end section includes a main bolster extending laterally thereacross;

said main bolster has first and second ends at lateral extremities thereof laterally outboard of said first truck center; and jacking points are defined at said first and second ends of said main bolster.

19. The railroad well car body unit of claim 12 wherein said first side beam has a relief defined therein to accommodate a first truck of said railroad freight car and said lifting interface member is mounted to said side sill adjacent to said relief.

20. The railroad well car body unit of claim 19 wherein said well car body unit has an end sill member extending between said first end of said first side sill and a corresponding first end of a corresponding side sill of said second side beam, and said lifting interface member extends along said first side sill in a region thereof between said end sill member and said first cross-member.

21. The railroad well car body unit of claim 12 wherein said lifting interface member undergirds said side sill.

22. The railroad well car body unit of claim 12 wherein said first side sill has an underside, and said lifting interface member includes a doubler mounted to said underside of said first side sill.

23. The railroad well car body unit of claim 22 wherein said doubler is a removable sacrificial member.

24. The railroad well car body unit of claim 23 wherein said sacrificial removable member is made from any one of (a) steel; (b) an UHMW polymer; and (c) a composite-reinforced polymer resin.

25. The railroad well car body unit of claim 12 wherein said railroad well car is a multi-body-unit railroad car.

26. The railroad well car body unit of claim 12 wherein said railroad well car is an articulated railroad well car having at least a first body unit, a second body unit, and a first shared truck located between said first body unit and said second body unit; said first end section of a part of said first body unit; and said lifting interface member is mounted to said first side sill next adjacent to said first shared truck.

27. The railroad well car body unit of claim 12 wherein:

said first side sill has a first leg and a second leg; said first leg extending predominantly upwardly; and said second leg extending predominantly laterally inwardly from a lowermost portions of said first leg.

28. A railroad well car body unit comprising:

first and second end sections;

first and second side beams;

said first and second side beams being spaced apart crosswise, and extending lengthwise between said first and second end sections whereby a well is defined between said first and second side beams and said first and second end sections;

said first end section having a truck center at which to mount a first railroad freight car truck;

said first side beam having a first side sill;

said first side sill having a first end adjacent to said first end section, and a second end distant from said first end section; and at least a portion of said first end of said first side sill having a lifting interface member mounted thereto;

said first side sill has a first leg and a second leg; said first leg extending predominantly upwardly; and said second leg extending predominantly laterally inwardly from a lowermost portions of said first leg;

said well car body unit has at least a first cross-member and a second cross-member;

said first cross-member extends between said first side beam and said second side beam and has first and second ends that mount upon respective second legs of respective side sills of said first and second side beams; beam and has first and second ends that mount upon said second cross-member extends between said first side beam and said second side respective second legs of respective side sills of said first and second side beams;

said first cross-member defines a first seat for an end of a shipping container;

said second cross-member defines a second seat for an end of a shipping container;

said first cross-member is located closer to said first end section than is said second cross-member; and said lifting interface member undergirds said first side sill and extends lengthwise relative thereto, said lifting interface member being located between said first end of said side sill and said first cross-member.

29. The railroad well car body unit of claim 28 wherein said first cross-member is connected to said first and second side beams at a moment connection.

30. The railroad well car body unit of claim 28 wherein said first side beam of said well car body unit has a vertical stiffener abreast of said first cross-member.

31. The railroad well car body unit of claim 28 wherein:

said first end section has panel extending across said car and mating with said first and second side beams, said panel defining an end bulkhead of the well;

said first side beam having a first predominantly upright stiffener located abreast of said end bulkhead;

said first side beam having a second predominantly upright stiffener located abreast of said first cross-member; and said first cross-member and said second predominantly upright stiffener of said side beam being joined at a moment connection.

32. The railroad well car body unit of claim 31 wherein said first side beam has a third predominantly upright stiffener located between said first and second predominantly upright stiffeners, and said lifting interface member extends long said side sill to either side of said third predominantly upright stiffener.

* * * * *

UNITED STATES PATENT AND TRADEMARK OFFICE

CERTIFICATE OF CORRECTION

PATENT NO. : 8,973,508 B2
APPLICATION NO. : 13/745147
DATED : March 10, 2015
INVENTOR(S) : Mohammed Al-Kaabi et al.

It is certified that error appears in the above-identified patent and that said Letters Patent is hereby corrected as shown below:

In the claims

In claim 23, column 12, line 51: “sacrificial” should be removed

In claim 24, column 12, line 53: “sacrificial” should be removed

Signed and Sealed this
Sixth Day of October, 2015

Michelle K. Lee

Michelle K. Lee
*Director of the United States Patent and Trademark Office*